United States Patent [19]

Ogawa

[11] 4,021,239

[45] May 3, 1977

[54] METHOD OF EXPOSING PARALLEL STRIPE-LIKE AREAS ON PHOTOSENSITIVE MEMBER

[75] Inventor: Kazuaki Ogawa, Atsugi, Japan

[73] Assignee: Sony Corporation, Tokyo, Japan

[22] Filed: May 17, 1976

[21] Appl. No.: 686,804

[30] Foreign Application Priority Data

May 20, 1975 Japan ..... 50-60004

[52] U.S. Cl. ..... 96/27 E; 96/27 R; 96/36.1; 96/44; 29/25.17; 29/25.18; 355/18; 355/54

[51] Int. Cl.[2] ..... G03C 5/04; G03C 5/00; G03C 5/06

[58] Field of Search ..... 96/27 R, 27 E, 36.1, 96/44; 29/25.17, 25.18; 313/329, 371, 390; 355/54, 18

[56] References Cited

UNITED STATES PATENTS

| | | | |
|---|---|---|---|
| 3,582,330 | 6/1971 | Kocsis | 96/36 X |
| 3,772,552 | 11/1973 | Kubota | 313/371 |
| 3,844,005 | 10/1974 | Yamada et al. | 29/25.17 |
| 3,856,525 | 12/1974 | Inoue | 96/27 E X |
| 3,890,151 | 6/1975 | Suzuki et al. | 96/36.1 |
| 3,893,856 | 7/1975 | Bestenreiner et al. | 96/27 R X |
| 3,936,302 | 2/1976 | Takami et al. | 96/36.1 |
| 3,971,043 | 7/1976 | Suzuki et al. | 96/36.1 X |

*Primary Examiner*—Edward C. Kimlin
*Attorney, Agent, or Firm*—Lewis H. Eslinger; Alvin Sinderbrand

[57] ABSTRACT

In the method of exposing a relatively large number of parallel, spaced apart stripe-like areas on the surface of a photo-sensitive member by directing light against such surface through an original photo-mask having a light-permeable pattern comprised of a relatively small number of parallel, spaced apart transparent stripes of lengths substantially smaller than the length of the areas to be exposed, and by effecting repeated relative scanning movements of the photo-sensitive member and photo-mask in the direction of the transparent stripes and relatively shifting the photo-sensitive member and the photo-mask in the direction transverse to the transparent stripes for each of the relative scanning movements so that, upon the completion of the repeated movements, light passing through the light-permeable pattern of the photo-mask will have scanned the desired relatively large number of stripe-like areas to be exposed on the surface of the photo-sensitive member; the transparent stripes of the original photo-mask are formed with respective lengths that decrease progressively from maximum values adjacent the center of the light-permeable pattern, considered in the direction of the relative shifting, to minimum values at the opposite sides of the pattern also considered in the direction of the relative shifting, and each relative shifting is effected through a predetermined distance equal to $(\frac{1}{2}^n)W$, in which $n$ is an integer and W is the effective width of the light-permeable pattern in the direction of the relative shifting, whereby to minimize variations in the pitch between adjacent exposed stripe-like areas on the photo-sensitive member due to unavoidable variations in the relative shifting of the photo-sensitive member and the original photo-mask.

7 Claims, 14 Drawing Figures

METHOD OF EXPOSING PARALLEL STRIPE-LIKE AREAS ON PHOTOSENSITIVE MEMBER

BACKGROUND OF THE INVENTION

1. Field of the Invention

This invention relates generally to the exposure to light of a predetermined pattern on a surface of a photo-sensitive member, and more particularly is directed to an improved method for effecting such exposure in a pattern composed of a large number of parallel, fine stripe-like areas.

2. Description of the Prior Art

There are various instances in which photo-etching techniques are employed for producing a fine striped pattern of a suitable material on a substrate. For example, in producing the target of a so-called storage tube, a layer of silicon is deposited on the inner surface of the face plate of the tube envelope to form an electrode, and the silicon layer has its surface oxidized to form an insulating layer of silicon dioxide thereon. Then, the silicon dioxide insulating layer is photo-etched to selectively remove portions thereof and leave a pattern of parallel, spaced apart insulating stripes between which the silicon electrode is exposed for impingement thereon by an electron beam when the latter scans the target in the direction transverse to the insulating stripes. However, since the pattern of insulating stripes is very fine, for example, each stripe may have a width of 5 microns and the pitch between adjacent stripes may be 10 microns, great difficulty is experienced in accurately producing the photo-mask to be used in connection with the photo-etching of the silicon dioxide insulating layer. Similar difficulties are encountered in producing a photo-mask for use in the attainment, by photo-etching techniques, of a pair of comb-shaped electrodes having patterns of interfitting, parallel, spaced apart stripe-like electrode elements on the target structure of an image pickup tube, for example, of the type disclosed in U.S. Pat. No. 3,772,552, issued Nov. 13, 1973, and having a common assignee herewith.

In producing a photo-mask for use in forming the above mentioned fine patterns of insulating stripes or stripe-like electrode elements by photo-etching, it has been proposed to first make a master drawing on a stable paper of only a small segment of the desired pattern which is drawn on a greatly enlarged scale, for example, 1000 to 2000 times actual size. Then, an original photo-mask is optically produced from the master drawing with suitable reduction of the scale thereof so that the widths of the several light-permeable stripes which are of uniform lengths and the pitches between the stripes on the original photo-mask are maintained within desired tolerances. The resulting original photo-mask is employed in a so-called photo-repeater in which light is directed from a suitable source through a shutter and the pattern of light-permeable stripes on the mask photo-mask against a photographic dry-plate or other photo-sensitive medium supported on a stage which is movable relative to the original photo-mask in orthogonally related directions extending parallel and transversely, respectively, to the direction of the light-permeable stripes. The stage is repeatedly scanned or moved relative to the original photo-mask in the direction parallel to the light-permeable stripes with the shutter being open only during each of such scanning movements and, in the intervals between the successive movements, the stage is displaced or shifted relative to the original photo-mask in the direction transverse to the light-permeable stripes by a distance corresponding to the effective width of the pattern of light-permeable stripes on the original photo-mask in such direction of shifting. Thus, at the completion of the repeated scanning movements, light passing through the light-permeable stripes of the original photo-mask will have exposed a relatively large number of stripe-like areas on the photo-sensitive medium with the lengths of such exposed stripe-like areas being substantially greater than the uniform lengths of the light-permeable stripes of the original photo-mask. When the exposed photo-sensitive medium is developed, the resulting photo-mask for use in a photo-etching process has the desired relatively large number of parallel transparent stripes which are separated by opaque or light shielding portions.

However, in the photo-mask obtained by the existing method, as described above, unacceptably large inaccuracies may occur in the pitch between adjacent transparent stripes which correspond to the last and first stripe-like areas, respectively, exposed on the photo-sensitive medium in two successive scanning movements of the stage relative to the original photo-mask. Such unacceptably large inaccuracies result from the inability to more precisely position the stage when the latter is shifted between successive scanning movements. If the target of a storage tube is produced by photo-etching with a photo-mask having relatively large variations in the pitch between certain adjacent transparent stripes of the photo-mask, the resulting insulating stripes on the target have corresponding pitch variations which, when a picture or image is reproduced on the storage tube, will appear as stripes causing deterioration of the picture quality.

OBJECTS AND SUMMARY OF THE INVENTION

Accordingly, it is an object of this invention to provide a method of producing a photo-mask having a fine pattern of parallel, spaced apart transparent stripes, and which avoids the above mentioned problems encountered in the prior art.

More particularly, it is an object of this invention to provide a photo-mask, as aforesaid, having a large number of parallel, spaced apart transparent stripes, and in which gross or relatively large variations in the pitch of such stripes is avoided.

In accordance with an aspect of this invention, in exposing a relatively large number of parallel, spaced apart stripe-like areas on a photo-sensitive surface by directing light against such surface through an original photo-mask having a light-permeable pattern comprised of a relatively small number of parallel, spaced apart, stripe-like light-permeable areas of lengths substantially smaller than the lengths of the stripe-like areas to be exposed on the photo-sensitive surface, and by effecting repeated relative scanning movements of the photo-sensitive surface and original photo-mask in a direction parallel to the stripe-like light-permeable areas so that light passing through the latter will scan the photo-sensitive surface along the full length of the stripe-like areas to be exposed thereon, and relatively shifting the photo-sensitive surface and the original photo-mask in the direction transverse to the direction of the relative scanning movements thereof for each of the repeated scanning movements so that, upon the completion of the latter, light passing through the light-permeable pattern of the original photo-mask will have scanned the desired relatively large number of stripe-like areas on the photo-sensitive surface: gross variations in the pitch between adjacent exposed stripe-like areas on the photo-sensitive surface are avoided by forming the stripe-like, light-permeable areas of the original photo-mask with respective lengths that decrease progressively from maximum values adjacent the center of the light-permeable pattern, considered in the direction of the relative shifting, to minimum values at the opposite sides of such pattern, also considered in the direction of the relative shifting; and by effecting each relative shifting through a predetermined distance which is substantially less than the effective width of the light-permeable pattern in the direction of the relative shifting so that each said stripe-like area on the photo-sensitive surface is exposed to a substantially uniform amount of light along the length thereof.

More particularly, it is a feature of the invention to relatively shit the photo-sensitive surface and the original photo-mask between successive scanning movements by a distance $(1/2^n)W$, in which $n$ is an integer and W is the effective width of the light-permeable pattern of the original photo-mask in the shifting direction.

The above, and other objects, features and advantages of the invention, will be apparent in the following detailed description thereof which is to be read in connection with the accompanying drawings.

DETAILED DESCRIPTION OF PREFERRED EMBODIMENTS

Figure 1:
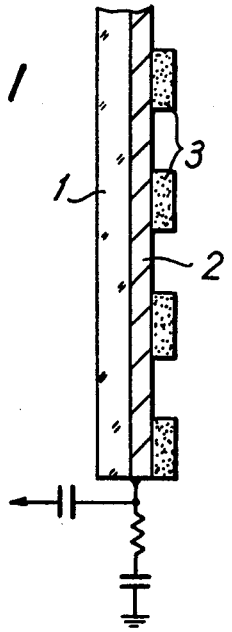
FIG. 1 is an enlarged, freagmentary sectional view of a portion of the target structure of a storage tube which may be produced by photo-etching techniques with a photo-mask formed by the method according to this invention.

Referring to the drawings in detail, and initially to FIG. 1 thereof, it will be seen that one example of a device having a fine striped pattern of a suitable material produced on a substrate by photo-etching techniques is the illustrated target of a so-called storage tube. In producing such target, a layer 2 of silicon is deposited on the inner surface of the faceplate 1 of the tube envelope to form an electrode, and the surface of the silicon layer 2 is oxidized to form an insulating layer of silicon dioxide thereon. Then, the silicon dioxide insulating layer is photo-etched to selectively remove portions thereof and leave a pattern of parallel, spaced apart insulating stripes 3 between which the silicon electrode 2 is exposed for impingement thereon by an electron beam (not shown) when the latter scans the target in the direction transverse to the insulating stripes 3. Since the pattern for insulating stripes 3 is very fine, for example, each stripe 3 may have a width of 5 microns and the pitch between adjacent stripes 3 may be 10 microns, great difficulty is experienced in accurately producing a photo-mask to be used in connection with the photo-etching of the silicon dioxide insulating layer.

In producing a photo-mask for use in forming the fine pattern of insulating stripes 3 by photo-etching, it has been proposed to first make a master drawing on a sheet of stable paper of only a small segment of the desired pattern which is drawn on a greatly enlarged scale. Then, an original photo-mask 5 (FIG. 3) is optically produced from the master drawing with suitable reduction of the scale thereof so that the widths of the several light permeable stripes 6 which are of uniform lengths and the pitches between the stripes on the original photo-mask 5 are maintained within the desired tolerances.

Figure 2:
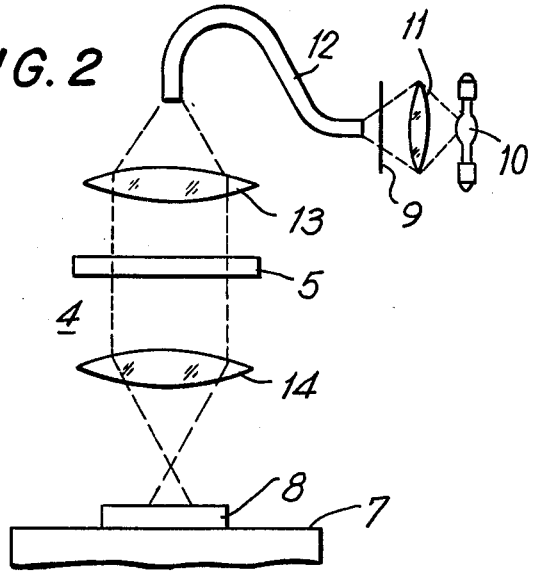
FIG. 2 is a schematic illustration of a photo-repeater that may be used in the method according to this invention.
Figure 3:
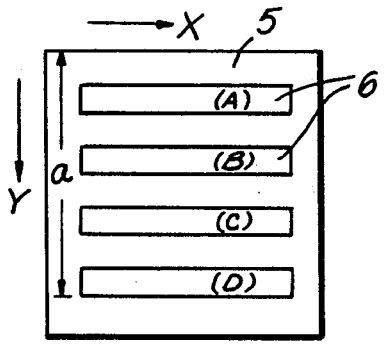
FIG. 3 PRIOR ART
FIG. 3 is an enlarged plan view of an original photo-mask of the type that is typically used according to the prior art in the photo-repeater of FIG. 2 for exposing a photo-sensitive medium in producing a photo-mask therefrom.
Figure 4:
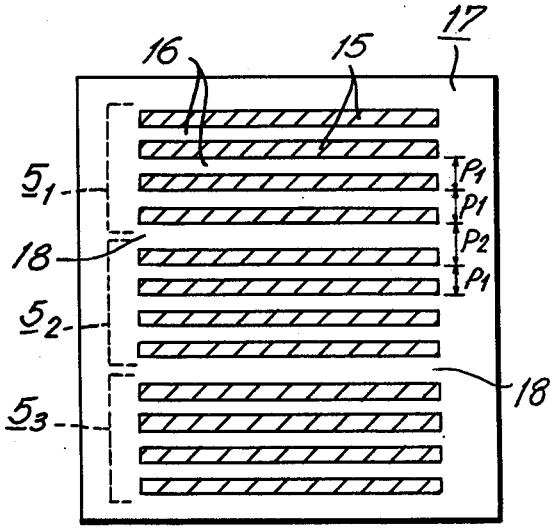
FIG. 4 PRIOR ART
FIG. 4 is a diagrammatic plan view showing the light-exposed areas of a photo-sensitive medium which has been exposed by a prior art method using the original photo-mask of FIG. 3.

In using the original photo-mask 5 of FIG. 3 which has only four relatively short light-permeable stripes 6, as indicated at A, B, C and D, for producing a photo-mask 17 (FIG. 4) which has, for example, twelve relatively long parallel, spaced apart light-permeable stripes 15, a so-called photo-repeater 4 (FIG. 2) is employed. In the typical photo-repeater 4 shown schematically on FIG. 2, light from a light source 10, such as, for example, a mercury-arc lamp of ultra-high pressure, is introduced through a condensing lens 11 and a shutter 9 into an optical fiber 12, and the light emerging from the optical fiber is directed through a condensing lens 13 against the original photo-mask 5 which is fixedly positioned between condensing lens 13 and a reducing lens 14. Accordingly, light passing through the transparent or light-permeable stripes 6 of original photo-mask 5 is focused onto a photographic dry-plate 8 or other photo-sensitive medium supported on a stage 7 which is movable relative to original photo-mask 5 in orthogonally related directions indicated by the arrows X and Y on FIG. 3, that is, in directions extending parallel and transversely, respectively, to the direction of the light-permeable stripes 6 of the original photo-mask 5.

In operating the photo-repeater 4 in accordance with the prior art, the stage 7 is repeatedly scanned or moved at a uniform speed relative to the original photo-mask 5 in the direction X, that is, parallel to the light-permeable stripes 6, with the shutter 9 being open only during each of such scanning movements. In the intervals between the successive scanning movements of stage 7, the latter is displaced or shifted relative to original photo-mask 5 in the direction Y, that is, the direction transverse to the light-permeable stripes 6, by a distance *a* (FIG. 3) that substantially corresponds to the effective width of the pattern of light-permeable stripes 6 on original photo-mask 5 in the shifting direction Y. It will be noted that such effective width *a* of the pattern of stripes 6 is equal to the product of the number of light-permeable stripes 6 and the pitch therebetween on the original photo-mask. If the original photo-mask 5 is formed with four light-permeable stripes 6 and the desired photo-mask 17 is to have 12 light-permeable stripes 15, as in the example shown on FIGS. 3 and 4, then three of the above described successive scanning movements of the stage 7 are effected. It will be apparent that, at the completion of such scanning movements, light passing through the light-permeable stripes 6 of the original photo-mask 5 will have exposed 12 stripe-like areas on the photographic dry-plate 8 with the lengths of such exposed stripe-like areas being possibly substantially greater than the uniform lengths of the light-permeable stripes 6 of the original photo-mask. When the exposed photographic dry-plate 8 or other photo-sensitive medium is developed, the resulting photo-mask 17 for use in a photo-etching process, for example, in forming the insulating stripes 3 on FIG. 1, has the desired relatively large number of parallel transparent stripes 15 which are separated by opaque or light shielding portions.

However, in the photo-mask 17 obtained by the existing method, as described above, unacceptably gross or sudden variations may occur in the pitch between adjacent transparent stripes 15. More particularly, in the illustrated photo-mask 17 resulting from three successive scanning movements of the stage 7 relative to the original photo-mask 5, as indicated at $5_1$, $5_2$ and $5_3$, the pitches $P_1$ between each group of adjacent transparent stripes 15 resulting from each such scanning movement will be uniform so as to provide the opaque or light shielding portions 16 between the group of four transparent stripes 15 with uniform widths. However, with existing photo-repeaters of the type indicated at 4 on FIG. 2, the positioning accuracy of the stage 7 when shifted in the direction Y on FIG. 3 is only about 0.2–0.3 microns, so that a similar inaccuracy can exist in the pitch $P_2$, and hence in the width of the opaque or light-shielding portion 18, between the transparent stripe 15 of photo-mask 17 resulting from exposure through the last stripe-like area D of original photo-mask 5 during the scanning movement indicated at $5_1$ on FIG. 4 and the transparent stripe 15 resulting from exposure by the first stripe-like area A of original photo-mask 5 during the next scanning movement indicated at $5_2$. If the target for a storage tube, as indicated on FIG. 1, is produced by photo-etching with the photo-mask 17 having relatively sudden variations in the pitch between adjacent transparent stripes 15, as shown on FIG. 4, the resulting insulation stripes 3 on the target have corresponding pitch variations which, when a picture or image is reproduced on the storage tube, will appear as stripes causing deterioration of the picture quality.

Figure 5:
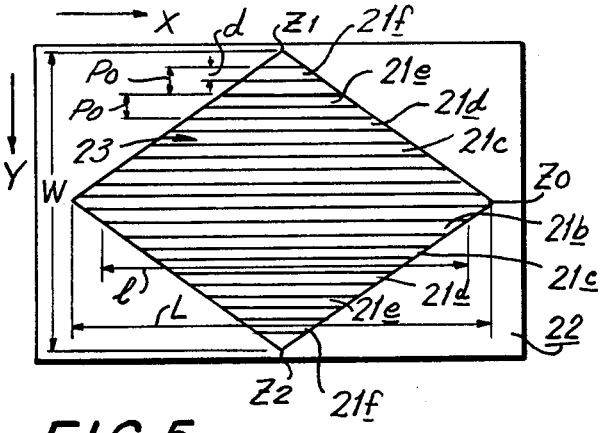
FIG. 5 is a plan view of an original photo-mask that is used in accordance with one embodiment of this invention.

Referring now to FIG. 5, it will be seen that the above problem resulting from relative inaccuracy in the positioning of the stage 7 of photo-repeater 4 when shifting the stage in the direction Y for successive scanning movements is substantially avoided by employing an original photo-mask 22 having a light-permeable pattern 23 made up of stripe-like, light-permeable areas 21 with respective lengths *l* that decrease progressively or linearly from a maximum value L adjacent the center $Z_o$ of the light-permeable pattern 23, considered in the direction Y of the relative shifting, to minimum values at the opposite sies $Z_1$ and $Z_2$ of the pattern 23, also considered in the direction Y. Further, when using the original photo-mask 22 in photo-repeater 4, the stage 7 is shifted in the direction Y relative to the fixed original photo-mask 22 for each of the successive scanning movements in the direction X through a predetermined sitance which is substantially less than the effective width W of the light-permeable patter 23 in the direction Y so that, at the completion of the successive scanning movements, each exposed stripe-like area on the photographic dry-plate or other photo-sensitive medium carried by stage 7 has been exposed to a substantially uniform amount of light along the length thereof. More particularly, in accordance with the invention, the photo-sensitive medium and the original photo-mask 22 are relatively shifted in the direction Y between successive scanning movements in the direction X by a distance $(1/2^n)W$, in which *n* is an integer and W is the effective width of light-permeable pattern 23, that is, the product of the number of stripe-like, light-permeable areas 21 and the uniform pitch $P_o$ provided therebetween, on the original photo-mask 22.

In the embodiment of the invention illustrated on FIG. 5, the pattern 23 of light-permeable stripe-like areas 21 is shown to be in the form of an equilateral parallelogram having two of its opposed corners aligned with the direction X of the relative scanning movements, while its other two opposed corners $Z_1$ and $Z_2$ are aligned in the direction Y of the relative shifting between successive scanning movements. Further, in the original photo-mask 22 of FIG. 5, there is a single stripe-like area 20*a* of the maximum length L extending along the center of the light-permeable pattern 23, and five additional stripe-like areas 21*b*–21*f* of uniform width *d* and linearly decreasing lengths are equally spaced apart between the central stripe-like area 21*a* and each of the opposite sides or corners $Z_1$ and $Z_2$.

Figure 6:
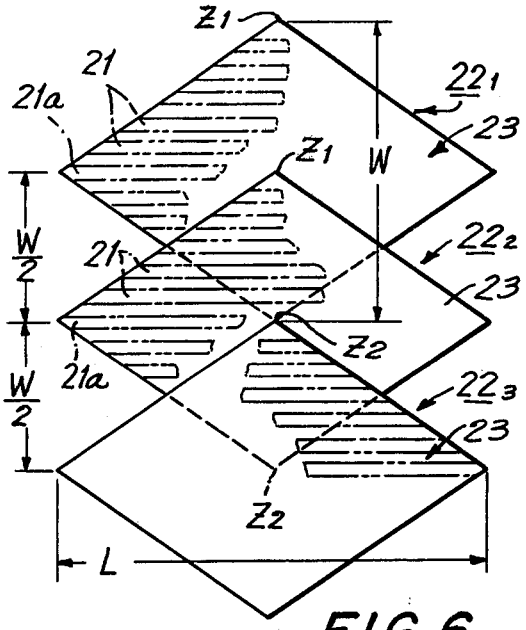
FIG. 6 is a schematic diagram illustrating the relatively shifted positions of the original photo-mask of FIG. 5 for successive scanning movements in accordance with an embodiment of the invention.
Figure 7:
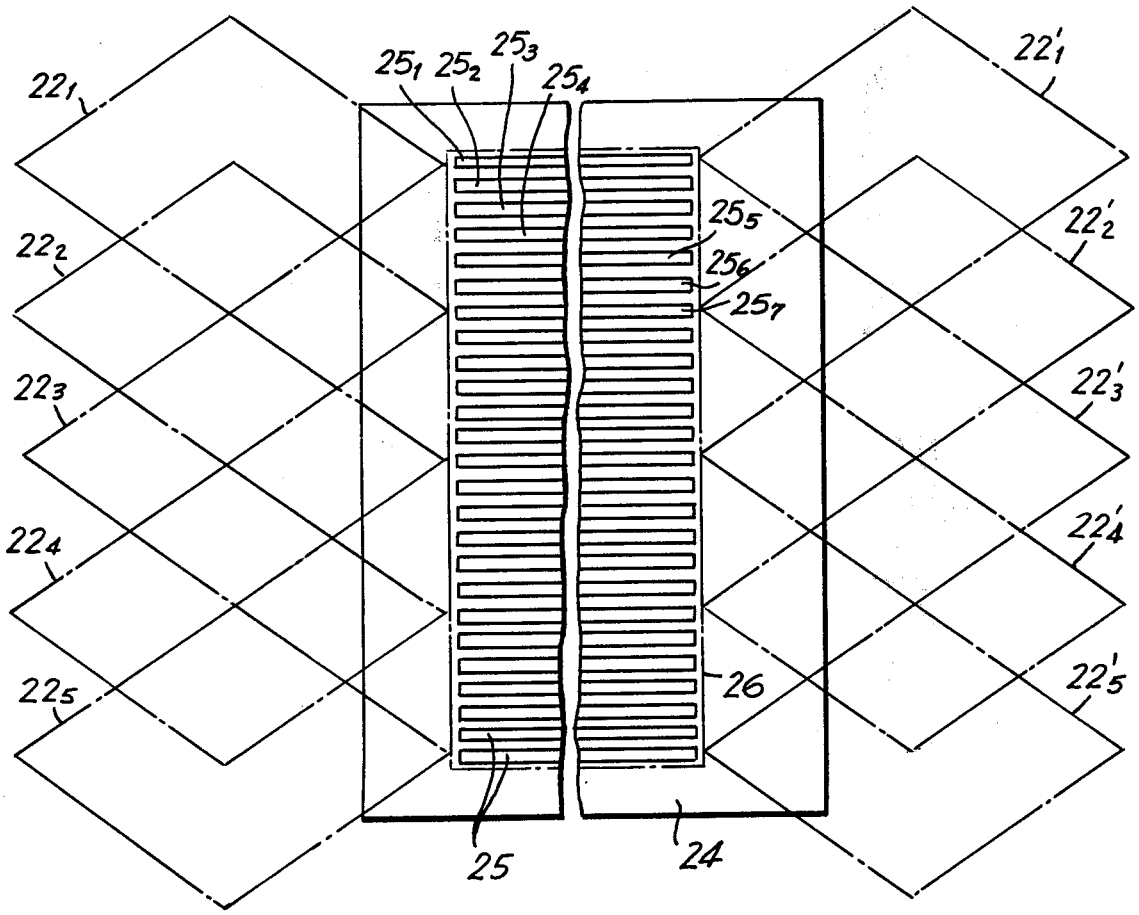
FIG. 7 is a diagrammatic plan view showing the light-exposed areas of a photo-sensitive medium which has been exposed by the method according to this invention using the original photo-mask of FIG. 5 and the relative shifting illustrated on FIG. 6.

Referring now to FIGS. 6 and 7, it will be seen that the original photo-mask 22 of FIG. 5 may be used in place of photo-mask 5 in the photo-repeater 4 to expose a photographic dry-plate 24 or other photosensitive medium which is mounted on the stage 7. When the original photo-mask 22 is employed, the stage 7 is shifted in the direction Y through a distance $(1/2^n)W$, for example, ½ W as on FIGS. 6 and 7, intermediate the successive scanning movements in the direction X of the stage 7 relative to the fixed original photo-mask 22. In the case where the original photo-mask 22 has eleven light-permeable stripe-like areas 21 of varying lengths, as described above, five scanning movements of the photo-sensitive medium 24 on stage 7 relative to the fixed photo-mask 22, for example, from the relative positions $22_1$–$22_5$ to the respective relative positions $22'_1$–$22'_5$ on FIG. 7, are required to provide the medium 24 with twenty-five substantially uniform spaced apart exposed stripe-like areas 25. If the exposed stripe-like areas 25 are to be confined within a rectangular region on the photo-sensitive medium 24, a suitable opaque frame (not shown) may be disposed over the medium 24 to provide a window indicated in broken lines at 26 which corresponds to the desired rectangular region to be occupied by the exposed stripe-like areas 25.

It will be apparent that, by arranging the light-permeable stripe-like areas 21*a*–21*f* of original photo-mask 22 as described above and by relatively displacing or shifting the stage 7 in the direction Y through the distance W/2 after each scanning movement, each of the stripe-like areas 25 of photo-sensitive medium 24 will be exposed to light passing through the longest stripe-like areas 21*a* during a single scan or to light passing through one of the stripe-like areas 21*b*, 21*c*, 21*d*, 21*e* and 21*f* and a respective one of the stripe-like areas 21*f*, 21*e*, 21*d*, 21*c* and 21*b* during two successive scans. As a result of the linearly decreasing lengths of the stripe-like areas 21*a*–21*f*, each of the exposed stripe-like areas 25 on the photo-sensitive medium 24 receives a substantially uniform aggregate amount of light. In other words, during each scan, the amount of light exposing each incremental area of the photo-sensitive medium 24 through one of the stripe-like areas 21*a*–21*f* is proportional to the length of such stripe-like area of the original photo-mask 22. In each case where an incremental area of the medium 24 is exposed in two successive scans, for example, through a stripe-like area 21*b* in a first scan and through a stripe-like area 21*f* in a second scan, the combined length of such stripe-like areas 21*b* and 21*f* is equal to the length of the stripe-like area 21*a* and, therefore, the amount of light for exposure is the same as that passing through the area 21*a* in a single scan.

Of course, when shifting the stage 7 between successive scanning movements, the distance through which the stage 7 is shifted in the direction Y is selected to cause substantial registration of the areas on medium 24 which are exposed through stripe-like areas 21*b*, 21*c*, 21*d*, 21*e* and 21*f* in one scan with the areas on the medium 24 which are exposed through the stripe-like areas 21*f*, 21*e*, 21*d*, 21*c* and 21*b*, respectively, in the next following scan. However, due to the inherent inaccuracy in the positioning of the stage 7 in the Y-direction, which inaccuracy may range from 0.2 to 0.3 microns, exact registration of the scanned areas cannot be achieved. It is an important advantage of this invention that the foregoing inaccuracy in the shifting of stage 7 in the Y-direction does not result in a sudden or gross variation in the pitch between the adjacent transparent stripes that are produced by development of the exposed photo-sensitive medium 24.

Figure 8:
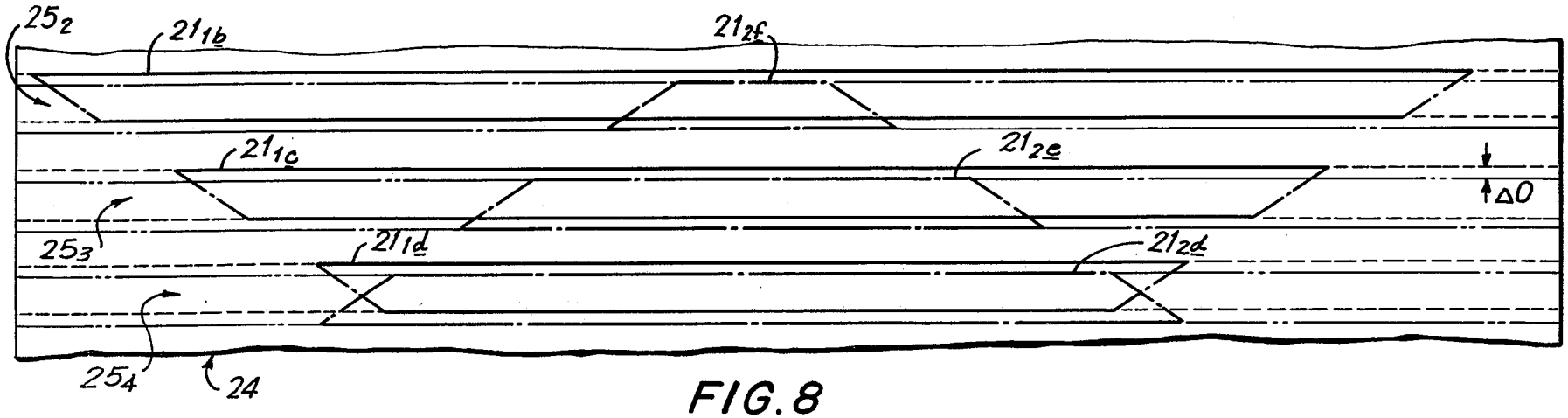
FIG. 8 is a fragmentary diagrammatic view corresponding to a portion of FIG. 7, but showing in full and broken lines the stripe-like areas that are exposed, by way of example, in two successive scans with the method according to this invention.

The manner in which the foregoing advantage of the invention is achieved will now be described with reference to FIGS. 8, 9A and 9B on which the deviations from exact registration of the areas exposed in two successive scans are shown in an exaggerated manner. On FIG. 8, the stripe-like areas $25_2$, $25_3$ and $25_4$ on the photo-sensitive medium 24 are shown to be exposed, in a first scan, by light passing through the stripe-like areas $21_{1b}$, $21_{1c}$ and $21_{1d}$ having progressively decreasing lengths. Further, in the next following or second scan, the medium 24 is exposed through stripe-like areas $21_{2f}$, $21_{2e}$ and $21_{2d}$ approximately along the stripe-like areas $25_2$, $25_3$ and $25_4$, respectively, but with the second-scanned areas being offset or deviating by $\Delta$ 0 with respect to the corresponding first-scanned areas. As previously noted, the amount of light impinging on each incremental area of medium 24 through a light-permeable stripe-like area 21 of original photo-mask 22 is dependent upon the length of such stripe-like area 21. More particularly, the intensity of illumination by the light source 10 is selected so that exposure of the medium 24 in a single scan through the longest stripe-like area 21*a* of photo-mask 22 will be sufficient to cause the respective area of the medium 24 to be transparent when developed; whereas exposure of the medium 24 in a single scan through the shortest stripe-like area 21*f* will not be sufficient to produce transparency upon development of the exposed medium. Thus, as is shown on FIG. 9A, in the case of the stripe-like area $25_2$ on medium 24, in the first scan, light passing through the relatively long stripe-like area $21_{1b}$ of the original photo-mask causes exposure to the relatively high level $E_{1b}$ along a stripe-like area which has a width $d$ and is centered at $C_1$, as indicated at I. In the second scan, light passing through the relatively short stripe-like area $21_{2f}$ causes exposure to the relatively low level $E_{2f}$ along a stripe-like area of the same width as previously, but centered at $C_2$ which is offset by $\Delta$ 0 from the center $C_1$, as indicated at II. After two scans, the total exposure at the region of the stripe-like area $25_2$ on medium 24 is as indicated at III on FIG. 9A. Although the width of the total exposure is $d+\Delta 0$, it will be seen that the level or extent of the exposure varies across such width. Furthermore, when the exposed photo-sensitive medium 24 is developed, only those regions of the medium which have been exposed at least to the level indicated at M on FIG. 9A will become transparent. Therefore, upon development of the medium 24, the total exposure indicated at III on FIG. 9A will produce a transparent stripe $25'_2$ as indicated at IV on FIG. 9A, and the center $C_{R2}$ of such developed transparent stripe $25'_2$ will be spaced only a very small increment $\Delta$ 0' from the center $C_1$ of the stripe-like area scanned through the area $21_{1b}$ in the first scan. Since the first stripe-like area $25_1$ on the medium 24 (FIG. 7) is exposed only through the stripe-like area 21*a* of the original photo-mask in the first scan from the relative position $22_1$ to the position $22'_1$, and such exposure is sufficient to cause the area $25_1$ to be transparent when the medium is developed for producing the desired photo-mask, it will be apparent that the pitch between the transparent stripes corresponding to the exposed stripe-like areas $25_1$ and $25_2$ will differ from the desired pitch $P_o$ only by the very small deviation $\Delta$ 0'.

Figure 9B:
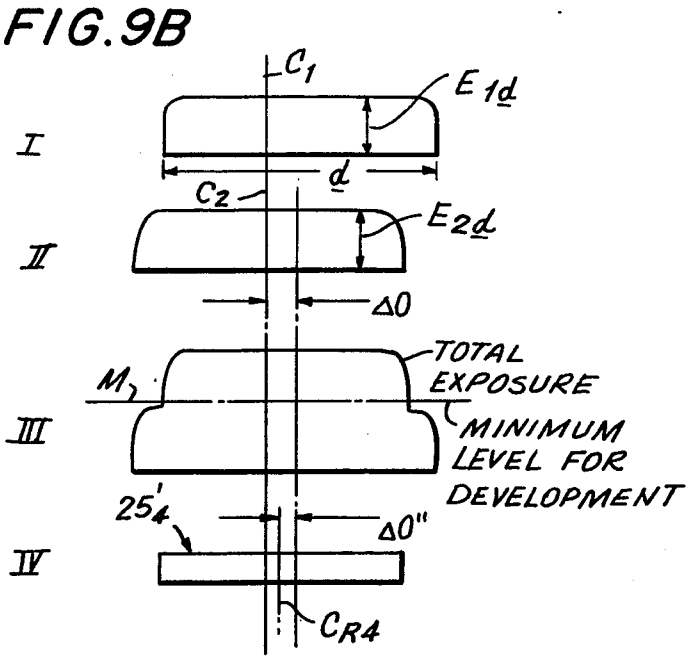
FIGS. 9A and 9B are diagrammatic illustrations to which reference will be made in explaining how gross or sudden variations in the pitch between adjacent transparent stripes of a photo-mask are avoided when such photo-mask has been exposed by the method according to this invention.
Figure 9A:
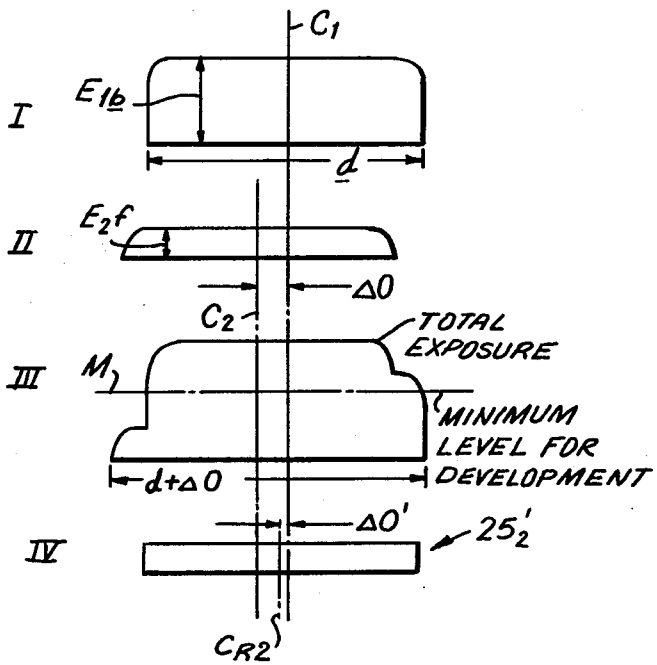

Referring now to FIG. 9B, it will be seen that, in the case of the stripe-like area $25_4$ on medium 24, light passing through the stripe-like area $21_{1d}$ in the first scan causes exposure of the medium to the level $E_{1d}$, as indicated at I; whereas, as shown at II, light passing through the stripe-like area $21_{2d}$ in the second scan causes exposure of the medium to the level $E_{2d}$ which is the same as the level $E_{1d}$ since the stripe-like areas $21_{1d}$ and $21_{2d}$ are of equal lengths. Further, since neither of the exposure levels $E_{1d}$ or $E_{2d}$ is as high as the minimum level M of exposure required to make the medium 24 transparent upon the development thereof, the total exposure indicated at III on FIG. 9B exceeds the minimum exposure level M only where the exposures of the first and second scans are added to each other. Therefore, upon development of the exposed medium 24, the total exposure indicated at III on FIG. 9B will produce a transparent stripe $25'_4$, as indicated at IV, which is centered at $C_{R4}$ approximately midway between the centers $C_1$ and $C_2$ of the respective areas exposed in the first and second scans. In other words, the displacement $\Delta 0''$ of the center $C_{R4}$ of the developed transparent stripe $25'_4$ from the center $C_1$ of the first scanned stripe-like area will be about ½ the deviation of inaccuracy $\Delta 0$.

Although only the deviations of the centers of the transparent stripes $25'_2$ and $25'_4$ of the developed photosensitive medium have been described above in detail with reference to FIGS. 8, 9A and 9B, it will be apparent that if the relative shift in the Y-direction on FIG. 6 between the first scan and the second scan is $W/2+\Delta 0$, the pitches between the successive developed transparent stripes corresponding to the exposed stripe-like areas $25_1$–$25_7$ on FIG. 7 will gradually increase, from transparent stripe to transparent stripe, by the increment $\Delta 0'$ on FIG. 9A, which increment $\Delta 0'$ is only a fraction of the shift inaccuracy $\Delta 0$. More particularly, the pitch deviation $\Delta 0'$ between any two successive pitches is $1/N \cdot \Delta 0$, in which N is the number of stripe-like areas on the medium which are overlapped into two successive scans.

Therefore, when the medium 24 which has been exposed in accordance with this invention is developed, the resulting photo-mask can be used to produce a fine striped pattern, for example, the spaced, parallel insulating stripes 3 of FIG. 1, by photo-etching, without the possibility of gross or sudden variations in the spacing between such insulating stripes.

In a particular example of the method described above with reference to FIGS. 5–7, the original photo-mask 22 of FIG. 5 was provided with an effective width W of 8mm., and light-permeable stripe-like areas 21 having a width *d* of 50 microns, a pitch $P_o$ of 100 microns and a maximum length L of 30mm. The lens 14 of the photo-repeater 4 effected a 1:10 reduction of the image of photo-mask 22 as projected on the photo-sensitive medium on stage 7, so that such projected image had corresponding dimensions W=0.8mm., *d*=5 microns, $P_o$=10 microns and L=3mm. Further, during each scan, the stage 7 was moved in the X-direction through a distance of 26mm. at the speed of 2.27mm/sec., and each shift in the Y-direction at the conclusion of a scan was through the distance 0.2mm. In the foregoing example, it was possible to produce a photo-mask having 2000 transparent, parallel stripes each with a length of 20mm., a width of 5 microns and a pitch of 10 microns between adjacent transparent stripes, and with the deviation of the width and pitch of the transparent stripes being held to within 0.1 micron.

Figure 10:
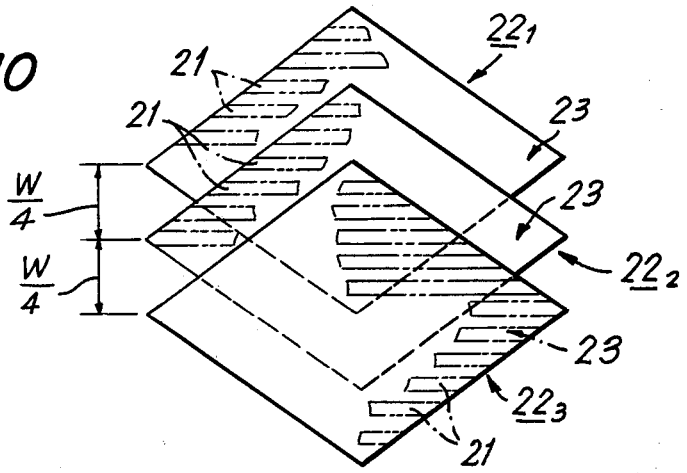
FIG. 10 is a view similar to that of FIG. 6, but showing the relatively shifted positions of the photo-mask of FIG. 5 for successive scanning movements in accordance with another embodiment of the invention.

On FIGS. 6 and 7, the relative shift in the Y-direction of the photo-sensitive medium on stage 7 and the original photo-mask 22 has been shown to be W/2, in which case each area of the photo-sensitive medium 24 is scanned twice by the pattern 23 of photo-mask 22. However, as previously mentioned, the shift in the Y-direction between successive scans can be $(½^n)W$, that is, W/4, W/8, W/16 - - - etc., in which cases $2^n$ scans are required for exposing each area of the photo-sensitive medium. Thus, for example, as shown on FIG. 10, the original photo-mask 22 of FIG. 5 may be employed with a shift of W/4 between successive scans, and, in that case, the usable exposed stripe-like areas of the photo-sensitive medium will be those areas which have been scanned four times. When the shift between successive scans is reduced, for example, to W/4 as on FIG. 10, the deviation or variation in the pitch between adjacent transparent stripes and in the widths of the latter in the photo-mask that results from development of the exposed photo-sensitive medium is still further reduced to increase the accuracy of such photo-mask.

Figure 11:
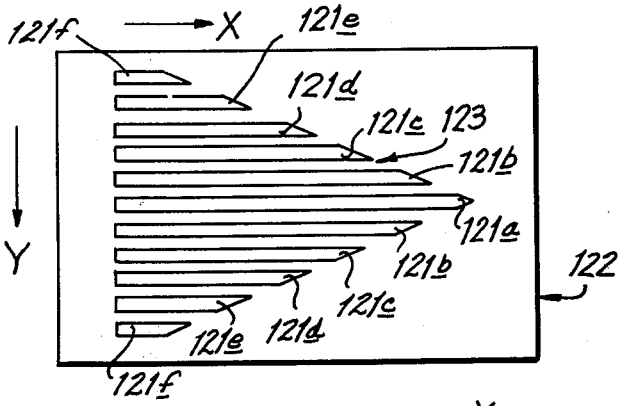
FIGS. 11, 12 and 13 are views similar to FIG. 5, but showing other light-permeable patterns that may be provided on the original photo-mask in accordance with other respective embodiments of the invention.

Although the original photo-mask 22 according to this invention has been shown on FIG. 5 to have its pattern 23 of light-permeable stripe-like areas 21 in the form of an equilateral parallelogram, other configurations of the light-permeable pattern may be employed. For example, as shown on FIG. 11, an original photo-mask 122 that may be used in place of the photo-mask 22 has its pattern 123 of light-permeable stripe-like areas **121*a*–121*f* in the form of an isosceles triangle with its apex extending in the direction X of the relative scanning movement, and with its longest stripe-like area 121*a* extending along the bisector of the triangle in the direction X. Further, in the triangular pattern 123, five light-permeable, stripe-like areas 121*b*–121*f* of progressively decreasing lengths are equally spaced apart at each of the opposite sides of the central stripe-like area 121*a***.

Figure 12:
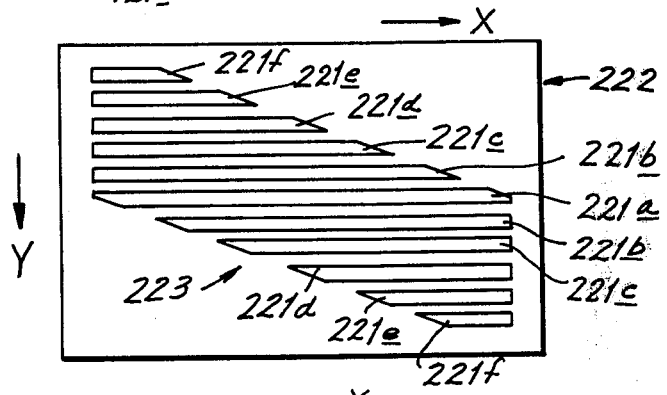

In another embodiment of an original photo-mask 222 according to this invention (FIG. 12), the light-permeable pattern 223 of stripe-like areas **221*a*–221*f* is shown to be in the form of a rhomboid having its relatively shorter sides extending parallel to the direction Y of relative shifting. Once again, the longest stripe-like area 221*a*, which extends along a diagonal of the rhomboid, is centered in the pattern 223, considered in the direction Y, and five light-permeable, stripe-like areas 221*b*–221*f* of progressively decreasing lengths are equally spaced apart at each of the opposite sides of the central stripe-like area 221*a***.

Figure 13:
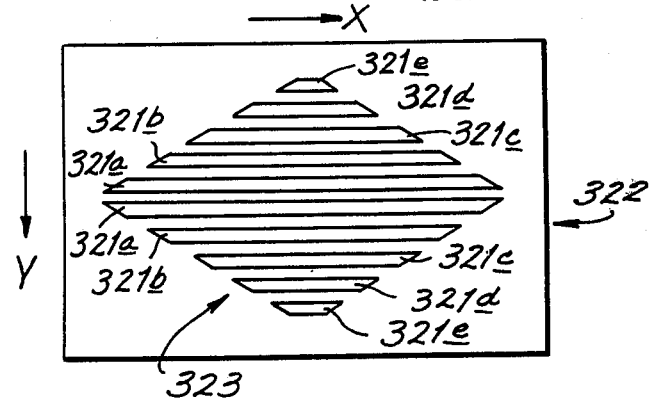

In each of the above described original photo-masks 22, 122 and 222 for use according to this invention, a single light-permeable, stripe-like area **21*a*, 121*a* or 221*a* of maximum length has been provided along the center of the respective pattern 23, 123 or 223. However, as shown on FIG. 13, an original photo-mask 322 which is otherwise similar to the photo-mask 22 may have two light-permeable, stripe-like areas 321*a* of equal maximum length arranged at opposite sides of the center line or median of the equilateral parallelogram pattern 323 extending in the scanning direction X. Further, the pattern 323 includes light-permeable, stripe-like areas 321*b*–321*e* which are equally spaced apart between each of the long stripe-like areas 321*a* of the respective side of the pattern. When using the original photo-mask 322 in accordance with this invention, the relative shifting of the photo-sensitive medium and the original photo-mask in the Y-direction after each scanning movement in the X-direction may be selected so that, for example, the area of the photo-sensitive medium exposed through a stripe-like area 321*e* in a second scan will substantially correspond with the area of the medium exposed through a stripe-like area 321*b*** in a first or preceding scan.

In all of the above, the method according to this invention has been described as being used for exposing a photo-sensitive medium in a striped pattern. However, if after exposure in such striped pattern, the photo-sensitive medium is turned through 90° on the stage 7 of the photo-repeater 4 and the exposing operations are repeated, then a fine checkered pattern of exposure can be obtained.

Although various embodiments of the invention have been described in detail herein with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. In the method of exposing a relatively large number of parallel, spaced apart stripe-like areas on a surface of a photo-sensitive member by the steps of directing light against said surface through an original photo-mask having a light-permeable pattern comprised of a relatively small number of parallel, spaced apart, stripe-like light-permeable areas of lengths substantially smaller than the lengths of said stripe-like areas to be exposed on said surface of the photo-sensitive member, effecting repeated relative movements of said photo-sensitive member and original photo-mask in a direction parallel to said stripe-like light-permeable areas so that light passing through the latter will scan said surface of the photo-sensitive member along the full length of said stripe-like areas to be exposed thereon, and relatively shifting said photo-sensitive member and said original photo-mask in the direction transverse to said direction of said relative movements thereof for each of said repeated relative movements so that, upon the completion of the latter, light passing through said light-permeable pattern of the original photo-mask will have scanned said relatively large number of stripe-like areas on said surface of the photo-sensitive member: the improvement comprising forming said stripe-like, light-permeable areas of the original photo-mask with respective lengths that decrease progressively from maximum values adjacent the center of said light-permeable pattern, considered in said direction of the relative shifting, to minimum values at the opposite sides of said pattern, also considered in said direction of the relative shifting; and effecting each said relative shifting through a predetermined distance which is substantially less than the width of said pattern in said direction of the relative shifting so that each said stripe-like area on said surface of the photo-sensitive member is exposed to a substantially uniform amount of light along the length thereof.

2. The method according to claim 1; in which said predetermined distance for each relative shift is equal to $(\frac{1}{2^n})W$, in which $n$ is an integer and W is said width of the light-permeable pattern.

3. The method according to claim 2; in which said light-permeable pattern is in the form of an equilateral parallelogram having two opposed corners thereof aligned with said direction of the relative movements of said photo-sensitive member and said original photo-mask.

4. The method according to claim 2; in which said light-permeable pattern is in the form of an isosceles triangle with its apex extending in said direction of the relative movements of said photo-sensitive member and said original photo-mask.

5. The method according to claim 2; in which said light-permeable pattern is in the form of a rhomboid having its relatively shorter sides extending parallel to said direction of the relative shifting of said photo-sensitive member and said original photo-mask.

6. The method according to claim 1; in which the intensity of said light directed through said original photo-mask and the speed of relative movement of said photo-sensitive member and said original photo-mask in said direction parallel to the stripe-like light-permeable areas are selected so that, in any one such relative movement, the exposure of a stripe-like area on said surface of the photo-sensitive member by light passing through each said stripe-like light-permeable area of minimum length is lower than the level thereof required for development of each exposed area.

7. The method according to claim 6; in which said intensity of the light and said speed of the relative movement are further selected so that, in any one said relative movement, the exposure of a stripe-like area on said surface of the photo-sensitive member by light passing through a stripe-like light-permeable area of maximum length is greater than said exposure level required for development.

* * * * *